US009902055B1

(12) United States Patent
Baker et al.

(10) Patent No.: US 9,902,055 B1
(45) Date of Patent: Feb. 27, 2018

(54) WELDING SLAG HAMMER

(71) Applicants: Daniel E. Baker, Riverside, CA (US); Kandis S. Baker, Riverside, CA (US)

(72) Inventors: Daniel E. Baker, Riverside, CA (US); Kandis S. Baker, Riverside, CA (US)

( * ) Notice: Subject to any disclaimer, the term of this patent is extended or adjusted under 35 U.S.C. 154(b) by 107 days.

(21) Appl. No.: 15/005,560

(22) Filed: Jan. 25, 2016

(51) Int. Cl.
*B25F 1/00* (2006.01)
*B25D 3/00* (2006.01)
*B25D 1/02* (2006.01)

(52) U.S. Cl.
CPC ..... *B25F 1/006* (2013.01); *B25D 1/02* (2013.01); *B25D 3/00* (2013.01)

(58) Field of Classification Search
CPC ..... B25F 1/006; B25D 1/02; B25D 3/00
USPC ..... 7/144–147; 81/25
See application file for complete search history.

(56) References Cited

U.S. PATENT DOCUMENTS

| | | | | | |
|---|---|---|---|---|---|
| 9,465 | A * | 12/1852 | Houston | B25D 1/02 | 125/40 |
| 817,512 | A * | 4/1906 | Palmer | B25D 7/00 | 125/43 |
| 874,730 | A * | 12/1907 | Bolderl | B25D 7/00 | 125/43 |
| 1,121,085 | A | 12/1914 | Fitzgerald | | |
| 1,449,136 | A * | 3/1923 | Yates | B25D 1/16 | 30/367 |
| 2,423,189 | A | 7/1947 | Honhart | | |
| 2,501,757 | A | 3/1950 | Cagle | | |
| 2,938,412 | A * | 5/1960 | Walker | B21D 1/06 | 125/40 |
| 3,821,824 | A | 7/1974 | Pilcher | | |
| 5,237,715 | A * | 8/1993 | Bane, III | B25F 1/006 | 7/139 |
| 5,255,575 | A | 10/1993 | Williams | | |
| 5,526,719 | A | 6/1996 | Chen | | |
| 5,983,430 | A * | 11/1999 | Clark | B25D 1/00 | 7/144 |
| 6,298,512 | B1 | 10/2001 | Hagen | | |
| 6,347,562 | B1 | 2/2002 | Gerber, Jr. | | |
| 6,536,308 | B1 | 3/2003 | Thorne et al. | | |
| 6,539,824 | B2 | 4/2003 | Wedhorn | | |
| 6,604,728 | B1 * | 8/2003 | Boydon | A45F 5/00 | 254/25 |
| 6,901,823 | B2 * | 6/2005 | Ernesti | B25B 13/46 | 7/138 |
| 2006/0019589 | A1 | 1/2006 | Wangler | | |
| 2010/0281621 | A1 * | 11/2010 | Moritz | B25B 13/06 | 7/147 |

* cited by examiner

*Primary Examiner* — Hadi Shakeri
(74) *Attorney, Agent, or Firm* — Robert C. Montgomery; Montgomery Patent & Design

(57) ABSTRACT

A hand tool adapted to be used in the welding environment includes a handle and a head. The head includes a first end adapted to strike at and remove welding slag and a second end adapted to receive and retain a replaceable tip. The tip has two (2) opposable ends such that it can be reversed to extend the life thereof. The handle end, distal from the head, is operatively shaped to comprise a wedge and a pry surface.

6 Claims, 5 Drawing Sheets

WELDING SLAG HAMMER

FIELD OF THE INVENTION

The present invention relates generally to a welding slag hammer.

BACKGROUND OF THE INVENTION

Large construction steel erection projects require a variety of tools and accessories in order to produce a high-quality job in a minimum amount of time. One (1) of these tools that have been used for generations is that of the slag hammer. Such hammers are used to remove extra weld splatter and hard slag consisting of excess steel, flux, and other contaminants that exist near the side of weld. These hammers also typically permit a user to maneuver bolt holes into alignment and separate touching steel components by use of a wedge incorporated into the hammer's handle.

Most slag hammers typically use a sharp pointed head to break through the crust of the slag. Of course, over time, such points become broken or dull, and require sharpening or even total replacement of the hammer. This not only is a costly endeavor, but slows down the work process while a new hammer is procured. Accordingly, there exists a need for a means by which the pointed head on a slag hammer can be ensured at all times in an effort to address the problems as described above while providing a chisel face, a pointed handle for aligning steel bolt holes, wedge and other accessories as would typically be found on a slag hammer. The use of the welding slag hammer meets all these needs in a manner which not only provides for fast easy work, but saves time and cost associated with total hammer replacement.

SUMMARY OF THE INVENTION

The inventor has recognized the aforementioned inherent problems and lack in the art and observed that there is a need for a welding slag hammer.

It is therefore the purpose of the inventor to provide a hammer comprising a head having a tip aperture located within a front end, a chisel located at a rear end, an impact area located on an upper face, a front shoulder disposed adjacent to the front end, a rear shoulder disposed adjacent to the rear end, a handle protruding perpendicularly from the head between the front shoulder and the rear shoulder of the head, and a tip configured to be removably secured within the tip aperture.

The head and the handle of the hammer may both be forged from a unitary piece of steel. In an alternate embodiment, the head and the handle may be forged from a unitary piece of strengthened steel. The hammer's front and rear shoulders may be configured to enable the hammer to be removably stowed within a scabbard of a support structure.

The aforementioned handle may taper to a spike at its lower end while an attachment aperture may run through an upper end of the handle at an angle perpendicular to the head. The handle may also further comprise a pair of grooves positioned on opposite sides and running parallel to each other. The spike may also have a wedge tip at its distal end.

The tip may also have a middle portion capable of securing the tip within the tip aperture and a pair of opposing distal ends which taper from the middle portion. Some tip embodiments have a retention device which is configured to secure the tip within the tip aperture. These tips may also comprise carbon steel and be zinc coated. In certain embodiments, the tip aperture comprises female threads and the middle portion of the tip comprises male threads.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
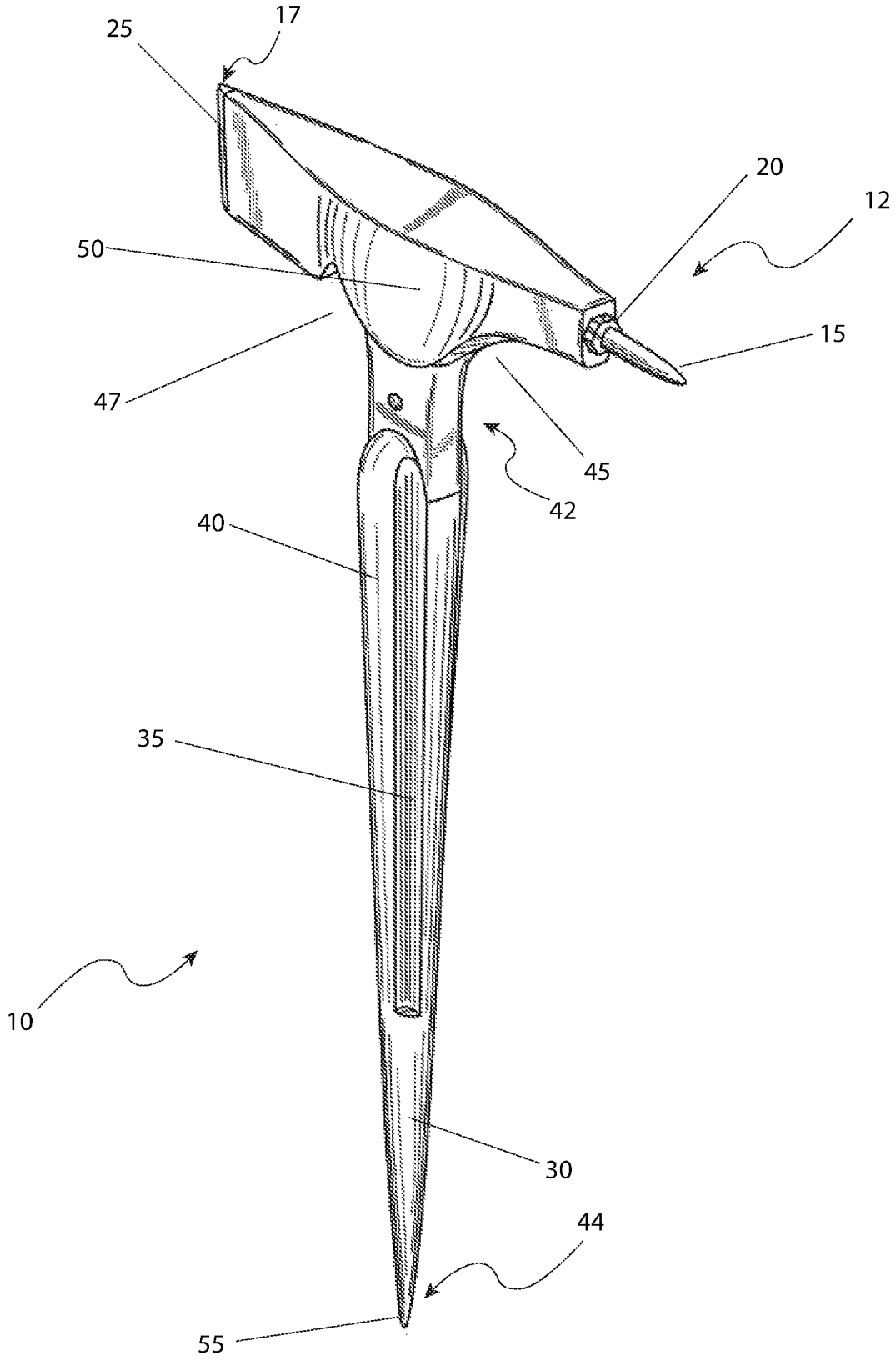
FIG. 1 is an isometric right side view of the welding slag hammer 10, according to the preferred embodiment of the present invention.

10 welding slag hammer
12 front end
15 replaceable tip
17 back end
20 retention device
25 vertical chisel
30 tapered spike
35 grooves
40 handle
42 upper handle
44 lower handle
45 front shoulder area
47 back shoulder area
50 head
55 wedge tip
60 tip aperture
65 female threads
70 attachment aperture
75 flat impact area
80 male threads
85 tapered conical shape
90 spike end
95 travel path "t"

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, an isometric view of the welding slag hammer 10, according to the preferred embodiment of the present invention is disclosed. Said welding slag hammer 10 comprises a generally hammer-shaped hand tool with the approximate dimensions of thirteen-and-a-half inches (13½ in.) tall and seven inches (7 in.) in width. The main head and handle area would be of a unitary construction ideally made of drop forged strengthened steel for improved strength and durability although other types of forged steel such as pressed are envisioned. A replaceable tip 15 and a retention device 20 are the remaining separate pieces of the welding slag hammer 10 and will be described in greater detail herein below.

The welding slag hammer 10 is also provided with a vertical chisel 25 on the back end 17 and opposite the replaceable tip 15 located on the front end 12 as would be expected with a conventional slag hammer. Both the replaceable tip 15 and vertical chisel 25 would be used to remove weld splatter and to remove hard slag remaining after welding operations. The welding slag hammer 10 is also provided with a tapered spike 30 which is located at the lower handle portion 44 that functions as a spud wrench and may be used to wedge the welding slag hammer 10 into place and/or align bolt or pin holes. The tapered spike 30 allows the welding slag hammer 10 to also be used a "T"-handle pry bar.

Two (2) grooves 35 are provided along the handle 40 to prevent the welding slag hammer 10 from slipping or spinning in a gloved hand during usage. The handle 40 is approximately one-and-a-quarter inches (1¼ in.) in diameter. A front shoulder area 45 and back shoulder area 47 are each formed between the handle 40 and a head 50 to allow the welding slag hammer 10 to be easily stowed in the scabbard of a tool belt or loop of work pants. Finally, the lower portion of the tapered spike 30 is provided with a wedge tip 55 to allow the welding slag hammer 10 to get between two (2) surfaces and pry them apart prior to lifting them apart.

Figure 2:
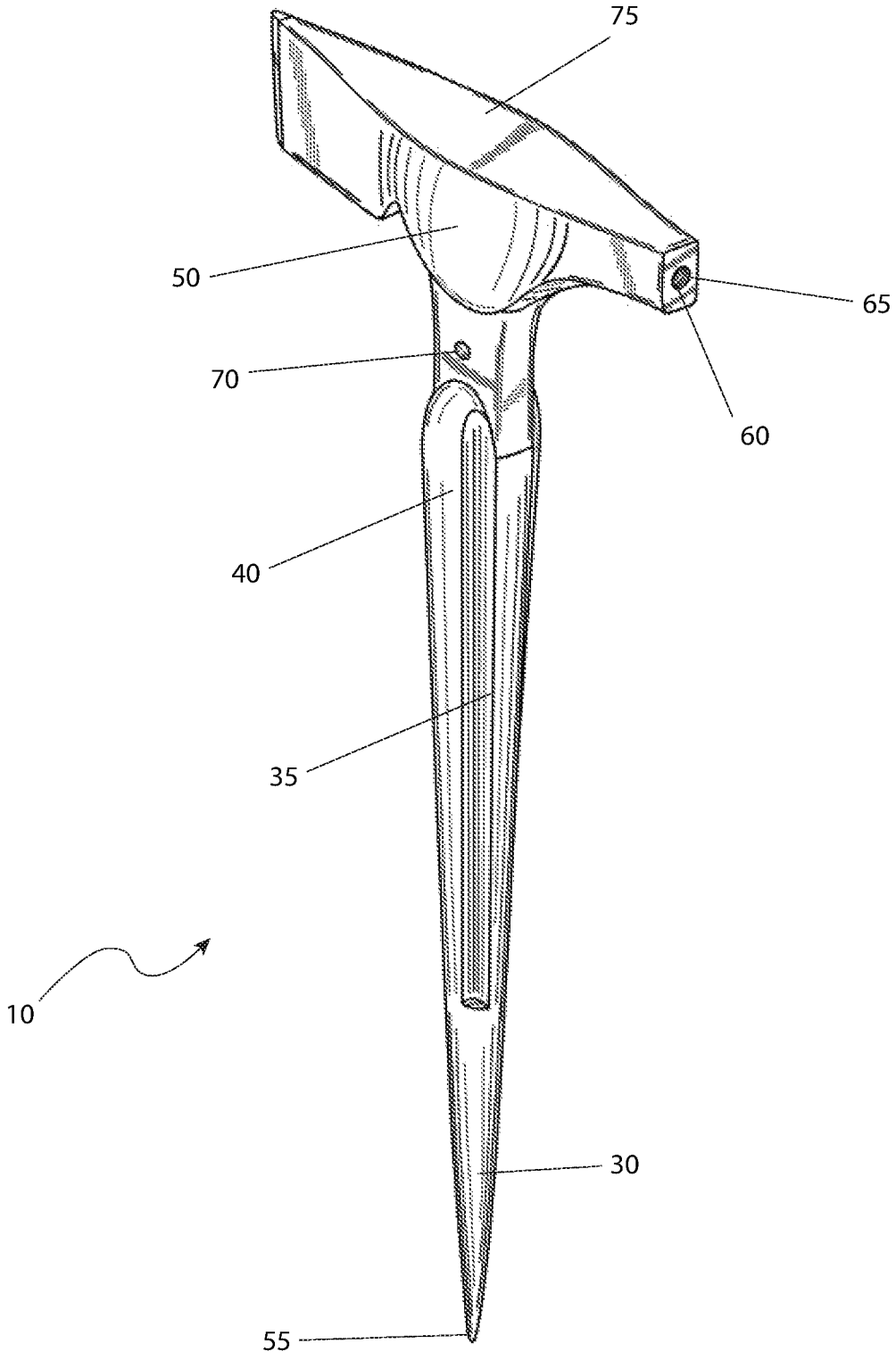
FIG. 2 is an isometric right side view of the welding slag hammer 10 with the replaceable tip 15 and retention device 20 removed, according to the preferred embodiment of the present invention.
Figure 3:
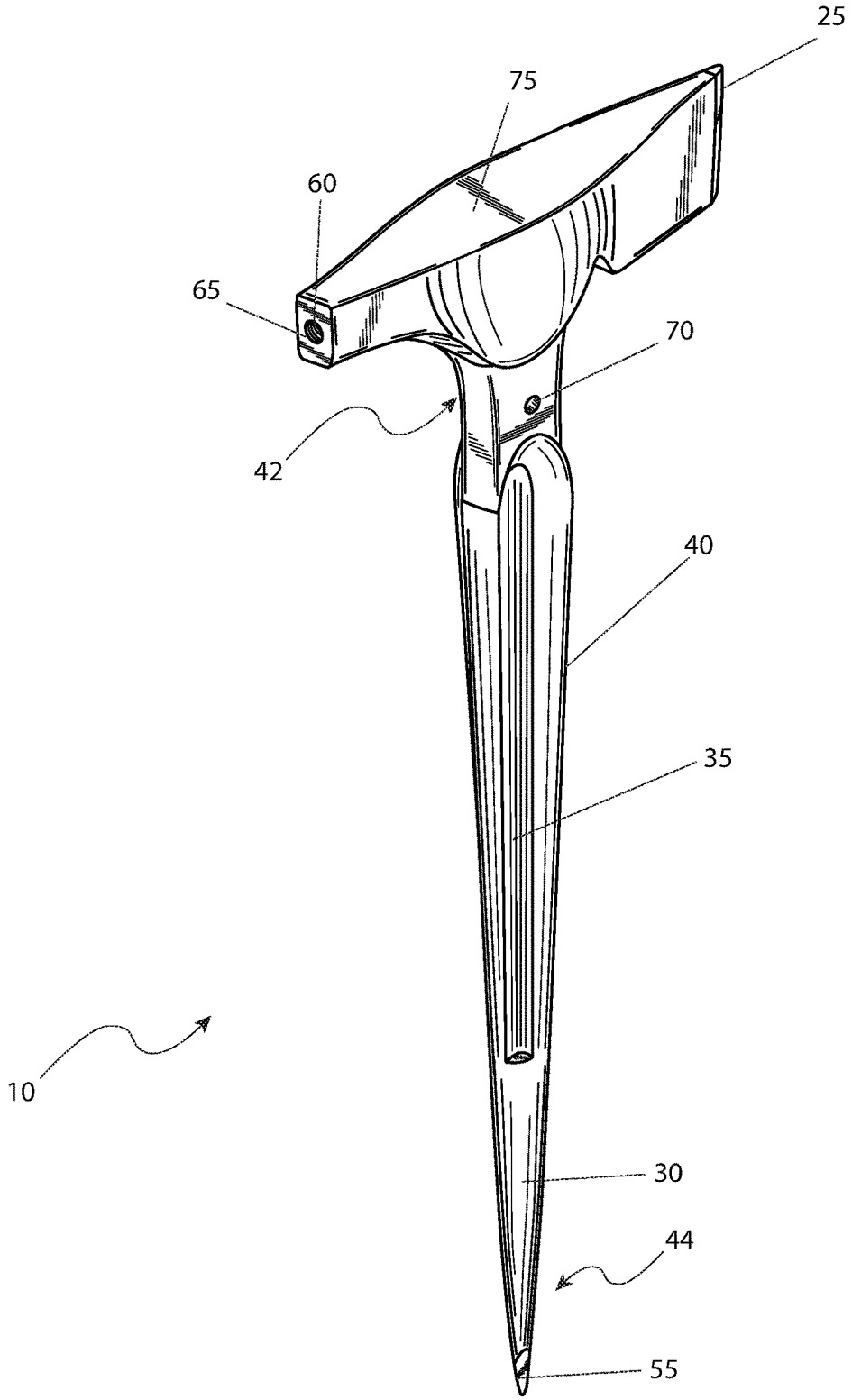
FIG. 3 is an isometric left side view of the welding slag hammer 10 with the replaceable tip 15 and retention device 20 removed, according to the preferred embodiment of the present invention.

Referring now to FIGS. 2 and 3, an isometric view of the welding slag hammer 10 with the replaceable tip 15 and retention device 20 removed, according to the preferred embodiment of the present invention is depicted. The head 50 is provided with a tip aperture 60 complete with female threads 65. Said threads are envisioned to be sized at three-eighths of an inch (⅜ in.), however, such thread sizes are not intended to be a limiting factor of the present invention. The tip aperture 60 is approximately one-and-a-half (1½ in.) inches deep (into the head 50) and is envisioned to taper slightly inward after the first three-quarters of an inch (¾ in.). The welding slag hammer 10 is provided with an attachment aperture 70 in the handle 40 of the welding slag hammer 10. Said attachment aperture 70 is envisioned to be approximately one-quarter of an inch (¼ in.) in diameter through the entire handle 40 and is issued for the purposes of attaching a leash for tethering purposes when working at heights. The head 50 of the welding slag hammer 10 is provided with a flat impact area 75 allowing it to be struck with a four to six pound (4-6 lb.) sledgehammer. This hammering operation would occur during use of the tapered spike 30 and wedge tip 55 features of the welding slag hammer 10.

Figure 4:
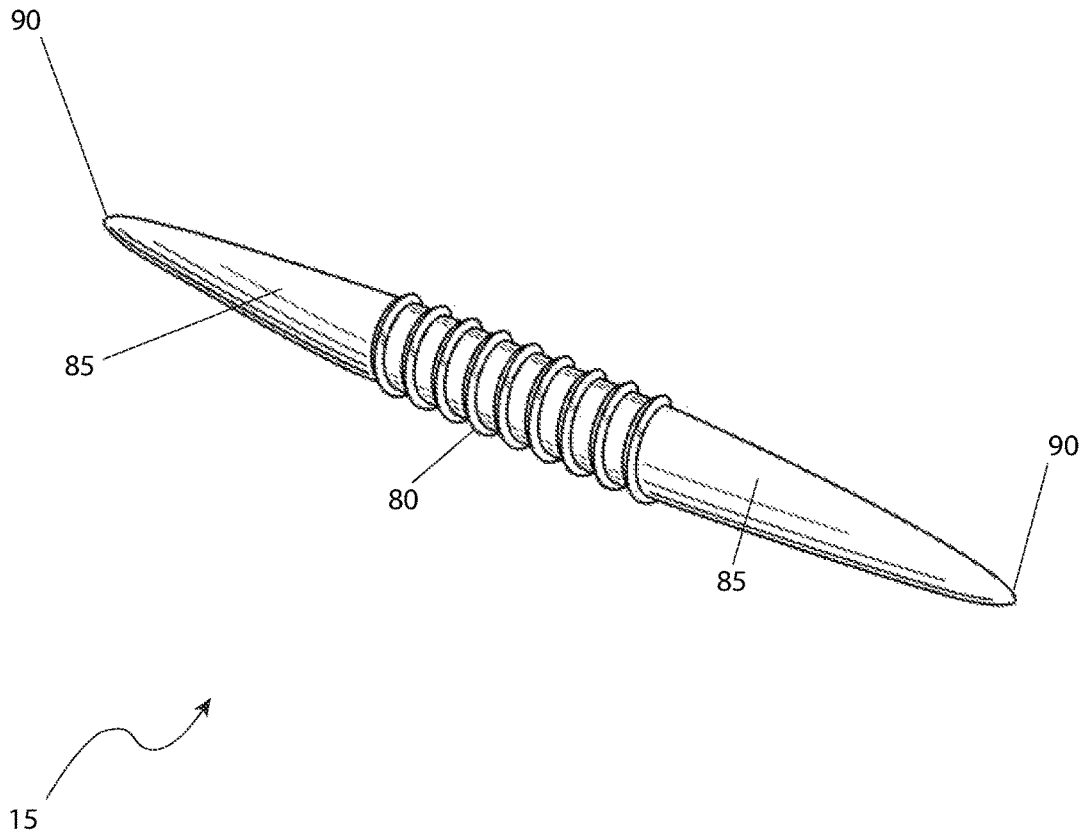
FIG. 4 is an isometric view of the replaceable tip 15 as used with the welding slag hammer 10, according to the preferred embodiment of the present invention; and, FIG. 5 is an isometric view of the replaceable tip 15, as used with the welding slag hammer 10, with the retention device 20 installed, according to the preferred embodiment of the present invention.

Referring next to FIG. 4, an isometric view of the replaceable tip 15 as used with the welding slag hammer 10, according to the preferred embodiment of the present invention is shown. The replaceable tip 15 is approximately three inches (3 in.) in length and three-eighths of an inch (⅜ in.) of an inch in diameter with slightly tapered ends. The middle section of the replaceable tip 15 is provided with male threads 80 that mate with the female threads 65 (as shown in FIGS. 2 and 3). The total length of the replaceable tip 15 provided with male threads 80 is envisioned to be approximately one inch (1 in.). The male threads 80 are envisioned to be approximately three-eighths of an inch (⅜ in.) in size, although such a parameter is not intended to be a limiting factor of the present invention. The outer portion of the replaceable tip 15 is provided in a tapered conical shape 85 with a spike end 90. Those skilled in the art will realize that the symmetrical nature of the replaceable tip 15 will allow it to be placed within the head 50 (as shown in FIGS. 2 and 3) of the welding slag hammer 10 in a total of two (2) different ways. This feature allows the user to remove the replaceable tip 15, rotate it one hundred eighty degrees (180°), and replace it in the welding slag hammer 10 when it becomes worn. Such rotation could occur once per replaceable tip 15 on an as-needed basis, perhaps as often as once a week during heavy daily usage. After both ends of the replaceable tip 15 are worn, the subject replaceable tip 15 would be removed, discarded, and replaced with a new replaceable tip 15. As such, it is envisioned that the replaceable tip 15 would be sold separately from the welding slag hammer 10 to reduce costs. The replaceable tip 15 is envisioned to be made of carbon steel coated with a five micrometer (5 μm) zinc coating for corrosion resistant properties. The replaceable tip 15 is envisioned to be highly useful around when performing welding operations around weld access holes or "rat holes" when welding flanges of I-beams and T-beams across their full width.

Figure 5:
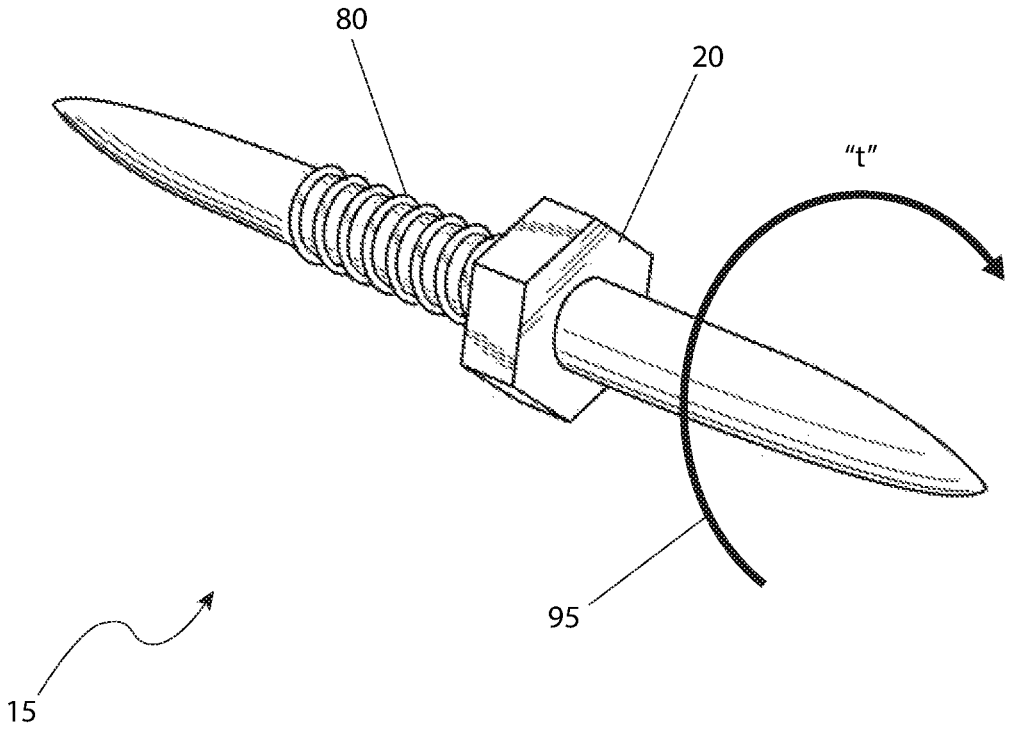

Referring finally to FIG. 5, an isometric view of the replaceable tip 15, as used with the welding slag hammer 10, with the retention device 20 installed, according to the preferred embodiment of the present invention is depicted. The retention device 20 is envisioned as a common three-eighths inch (⅜ in.) jam nut, thus matching the female threads 65 (as shown in FIGS. 2 and 3) and the male threads 80. This feature allows for easy replacement should it become lost as the commonality of the jam nut allows it to be found at almost all work sites. The retention device 20 is placed on the replaceable tip 15 using a turning motion as defined by a travel path 't' 95. This action tightens the retention device 20 up against the head 50 (as shown in FIG. 1) and prevents rotation and dislodgement of the replaceable tip 15 from the welding slag hammer 10.

The preferred embodiment of the present invention can be utilized by the common user in a simple and effortless manner with little or no training. It is envisioned that the welding slag hammer 10 would be constructed in general accordance with FIG. 1 through FIG. 5. After procurement of the welding slag hammer 10, envisioned to occur via conventional welding tool procurement methods, the user would ensure that a replaceable tip 15 is placed in the head 50 of the welding slag hammer 10 and tightly secured by a retention device 20, such that a non-worn spike end 90 is protruding outward.

At this point in time, the welding slag hammer 10 could be used as a conventional slag hammer to remove weld splatter and provide general post welding cleanup operations. Such operations would utilize the replaceable tip 15 and the vertical chisel 25 of the welding slag hammer 10. The welding slag hammer 10 may also be used for other assembly operations such as duplicating the action of a spud wrench or bull pin to align steel prior to bolting or welding. Prying and chiseling operations would be provided by the tapered spike 30 and the wedge tip 55. Such actions could also be amplified by hammering action upon the flat impact area 75 should additional leverage or force be required. These various work activities continue in a cyclical manner until the spike end 90 becomes too damaged to perform a proper job.

To replace or rotate the replaceable tip 15, the user would first loosen and remove the retention device 20 by following an inverted travel path 't' 95. Next, the replaceable tip 15 is removed by following the same rotational path as the retention device 20. The replaceable tip 15 can either be rotated, should the opposite spike end 90 be non-worn, or it can be replaced by a new replaceable tip 15. The replaceable tip 15 is placed into the head 50 of the welding slag hammer 10 by a tightening action as defined by the travel path 't' 95, followed by the retention device 20 in a similar manner. At this point in time, the welding slag hammer 10 is ready to return to use as defined above. Such usage, rotation, replacement process continues in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A hammer, comprising:

a head having;

a tip aperture located within a front end;

a chisel located at a rear end;

an impact area located on an upper face;

a front shoulder disposed adjacent to said front end; and, a rear shoulder disposed adjacent to said rear end;

a handle protruding perpendicularly from said head between said front shoulder and said rear shoulder; and, a tip configured to be removably secured within said tip aperture;

wherein said head and said handle are forged from a unitary piece of steel;

wherein said handle tapers to a spike at a lower end thereof;

wherein said handle further comprises a pair of grooves positioned on opposite sides thereof and running parallel to each other;

wherein said tip further comprises a middle portion capable of securing to said tip aperture and a pair of opposing distal ends, each tapering form said middle portion;

wherein said tip aperture further comprises female threads and said middle portion comprises male threads;

wherein said tip further comprises a retention device configured to secure said tip within said tip aperture; and wherein said front and rear shoulders are configured to enable said hammer to be removably stowed within a scabbard of a support structure.

2. The hammer of claim 1, wherein said handle further comprises an attachment aperture running through an upper end thereof perpendicular to said head.

3. The hammer of claim 1, wherein said spike further comprises a wedge tip at a terminal end thereof.

4. The hammer of claim 1, wherein said tip comprises carbon steel.

5. The hammer of claim 4, wherein said tip is zinc coated.

6. The hammer of claim 1, wherein said head and said handle are forged from a unitary piece of drop-forged strengthened steel.

* * * * *